US005307869A

United States Patent [19]

Blomgren

[11] Patent Number: 5,307,869

[45] Date of Patent: May 3, 1994

[54] PERMANENTLY JOINED PLATE HEAT EXCHANGER

[75] Inventor: Ralf Blomgren, Skanör, Sweden

[73] Assignee: Alfa-Laval Thermal AB, Lund, Sweden

[21] Appl. No.: 917,141

[22] PCT Filed: Jan. 23, 1991

[86] PCT No.: PCT/SE91/00048

§ 371 Date: Aug. 5, 1992

§ 102(e) Date: Aug. 5, 1992

[87] PCT Pub. No.: WO91/13308

PCT Pub. Date: Sep. 5, 1991

[30] Foreign Application Priority Data

Feb. 1, 1991 [SE] Sweden ..... 9000712

[51] Int. Cl.[5] ..... F28F 3/08

[52] U.S. Cl. ..... 165/167; 165/153

[58] Field of Search ..... 165/153, 167

[56] References Cited

U.S. PATENT DOCUMENTS

| | | | |
|---|---|---|---|
| 2,617,634 | 11/1952 | Jendrassik | 165/167 |
| 4,249,597 | 2/1981 | Carey | 165/166 |
| 4,287,945 | 9/1981 | Hessari | 165/167 |
| 4,708,199 | 11/1987 | Yogo et al. | 165/167 |
| 4,976,313 | 12/1990 | Dahlgren et al. | 165/167 |
| 4,987,955 | 1/1991 | Bergqvist et al. | 165/167 |
| 5,121,792 | 6/1992 | Schukey | 165/167 |

FOREIGN PATENT DOCUMENTS

| | | | |
|---|---|---|---|
| 3215961 | 11/1983 | Fed. Rep. of Germany | 165/173 |
| 859510 | 12/1940 | France | 165/153 |
| 1448155 | 8/1966 | France | 165/153 |
| 113651 | of 0000 | United Kingdom | 165/153 |
| 5866 | 10/1986 | World Int. Prop. O. . | |

*Primary Examiner*—John Rivell
*Assistant Examiner*—L. R. Leo
*Attorney, Agent, or Firm*—Davis Hoxie Faithfull & Hapgood

[57] ABSTRACT

In a plate heat exchanger each one of a stack of plate elements consists of two heat transfer plates which define between themselves a flow space for a heat exchange fluid and which are permanently joined together, for instance by brazing, around their edges and at several places distributed over the heat transfer portions of the plates. Each heat transfer plate has protuberances and depressions formed by pressing in its heat transfer portion and has port portions with at least four through flow openings. Adjacent plate elements are permanently joined together, for instance by brazing, only around each of the through flow openings. The stack of plate elements is held together by members extending through said through flow openings.

8 Claims, 2 Drawing Sheets

PERMANENTLY JOINED PLATE HEAT EXCHANGER

Figure 1:
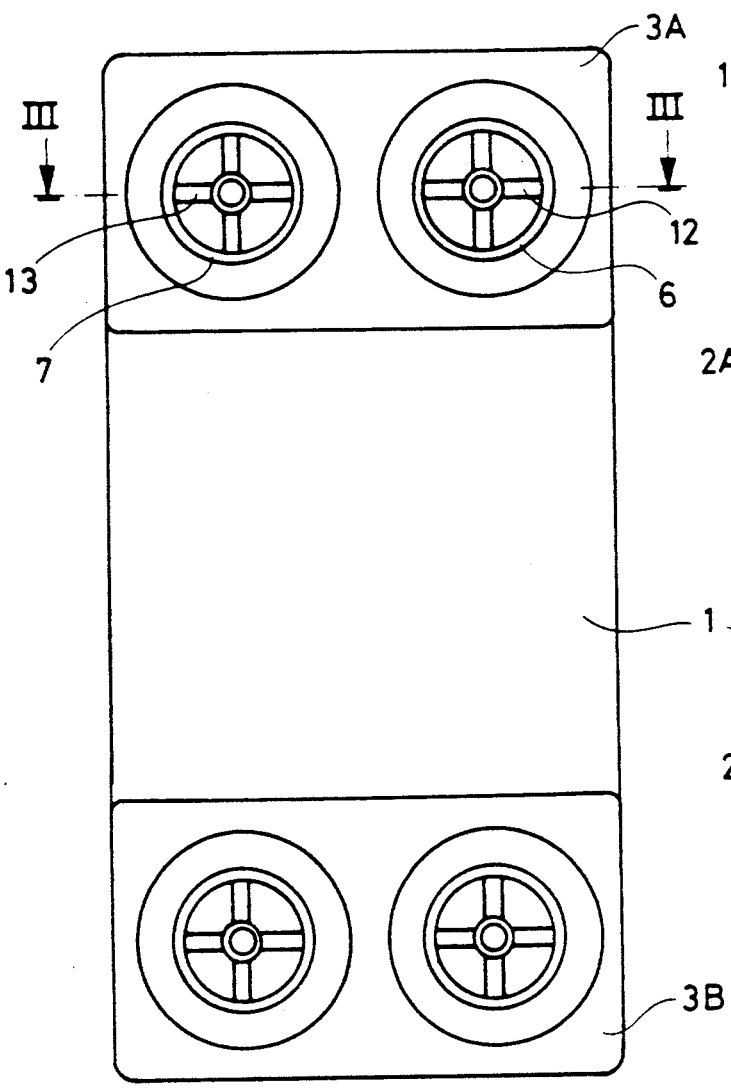

The present invention relates to a plate heat exchanger for transferring heat from one fluid to another, comprising a stack of plate elements, which are held together by holding members extending across the planes of the plate elements and each of which plate elements comprises two heat exchange plates having opposite heat exchange portions and port portions, respectively, which latter have aligned through-flow openings, the heat exchange plates in each plate element further being permanently joined together, e.g. by brazing, both around their edges and at several plates distributed over the heat exchange portions, and each heat exchange plate having protuberances and depressions formed by pressing in its heat exchange portion, two adjacent plate elements abutting closely against each other via the heat exchange portions of the respective heat exchange plates, so that heat transfer between the heat exchange plates is facilitated but a possible hole through one of them would allow outflow of fluid between the plate elements.

A plate heat exchanger of this kind is known by U.S. Pat. No. 4,249,597. In this known plate heat exchanger each heat exchange plate has only two through-flow openings, and each plate element is formed by two such heat exchange plates, one of which is turned 180° relative to the other around an axis in the plane of the plate. Two adjacent plate elements of this kind abut against each other only over the heat exchange portions of the heat exchange plates, one plate element being turned 180° around an axis perpendicular to the plate plane relative to the other plate elements, so that the port portions of one plate element are turned in one direction and the port portions of the other plate element are turned in the opposite direction.

The known plate heat exchanger further has two stiff end plates, which abut against the heat exchange portions of the respective outermost heat exchange plates and are connected with each other by means of two members holding them together and having the form of rods extending outside the stack of plate elements.

One drawback with the known plate heat exchanger is that its design presume heat exchange plates of a particular kind, i.e. heat exchange plates which can be used only in a double-wall arrangement according to U.S. Pat. No. 4,249,597.

Another drawback is that the heat exchange plates have to be oriented in several different ways relative to each other in connection with assembling of the plate heat exchanger.

A third drawback is that the rods holding the stack of plate elements together are not used to hold together certain joints between the different plate elements, which during operation of the heat exchanger will be subjected to particularly large forces acting to separate the plate elements from each other.

One object of the present invention is to provide a design for permanently joined plate heat exchangers of the initially defined kind, in which the treated fluids are kept separate by means of double heat exchange plates, which design makes possible cheaper and more simple production of such plate heat exchangers than the design which can be seen from U.S. Pat. No. 4,249,597.

Another object is to provide a plate heat exchanger of the said kind, which can be subjected to higher pressures from the heat exchange fluids in question than a plate heat exchanger according to U.S. Pat. No. 4,249,597.

These objects can be achieved by a design which is characterized in that each heat exchange plate has at least four port portions with through-flow openings, that the heat exchange plates in each plate element abut against each other and are permanently and fluid-sealingly connected with each other along a line surrounding the heat exchange portion of each heat exchange plate and at least two of its through-flow openings and, also, around each of the two other through-flow openings of each heat exchange plate, that adjacent plate elements abut against each other via the port portions of the respective heat exchange plates and are permanently and fluid-sealingly connected with each other around each of their through-flow openings, and that said holding member extend through the through-flow openings of the heat exchange plates.

A design of this kind makes it possible to use heat exchange plates of an already known kid, which thus can be used both for plate heat exchangers having single heat exchange plates and for plate heat exchangers having double heat exchange plates between the heat exchange fluids. Each double wall unit in a plate heat exchanger according to the invention preferably consists of two identically formed plates which completely cover each other and, thus, have been brought together without one of them having been turned in relation to the other, as in U.S. Pat. No. 4,249,497.

In a preferred embodiment of the plate heat exchanger according to the invention each holding member at each of its ends is connected with a stiff member that is stiffer than one single heat exchange plate and that is fluid-sealingly connected with the outermost plate element in the stack around an area aligned with the through-flow openings through which the holding member extends. Thereby, the forces in the areas of the through-flow openings of the plate elements, which forces for instance in a plate heat exchanger of the kind shown in U.S. Pat. No. 4,249,597 is striving at separating the plate elements from each other, will be taken up by the holding member, so that they will not harm the joints between the plate elements around the through-flow openings of the latter.

The above said stiff member at one end of the holding member may be constituted by a stiff plate and at the other end be constituted by a connecting member arranged for supply or discharge of a heat exchange fluid.

If desirable, the stack of plate elements in a plate heat exchanger according to the invention may be left without conventional, relatively thick and/or stiff end plates at its ends. However, preferably a stiff end plate is used at each of the stack ends, covering at least two through-flow openings in the outermost plate element and being connected with two connecting members. Since the connecting members are connected with the end plates in the very areas of the through-flow openings of the plate elements, the end plates may be made relatively thin, though.

Figure 2:
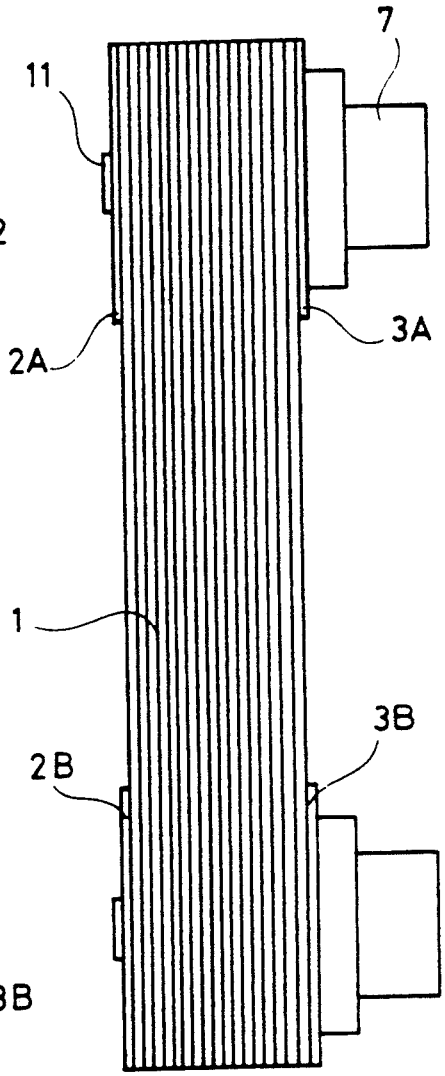
Figure 3:
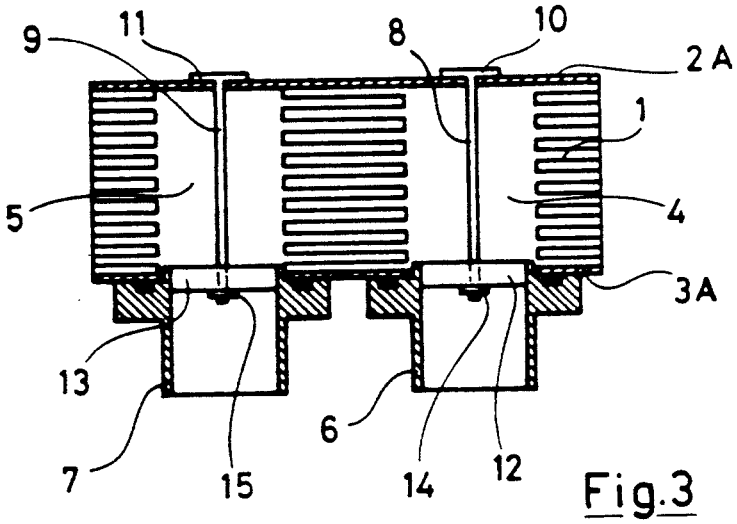
Figure 4:
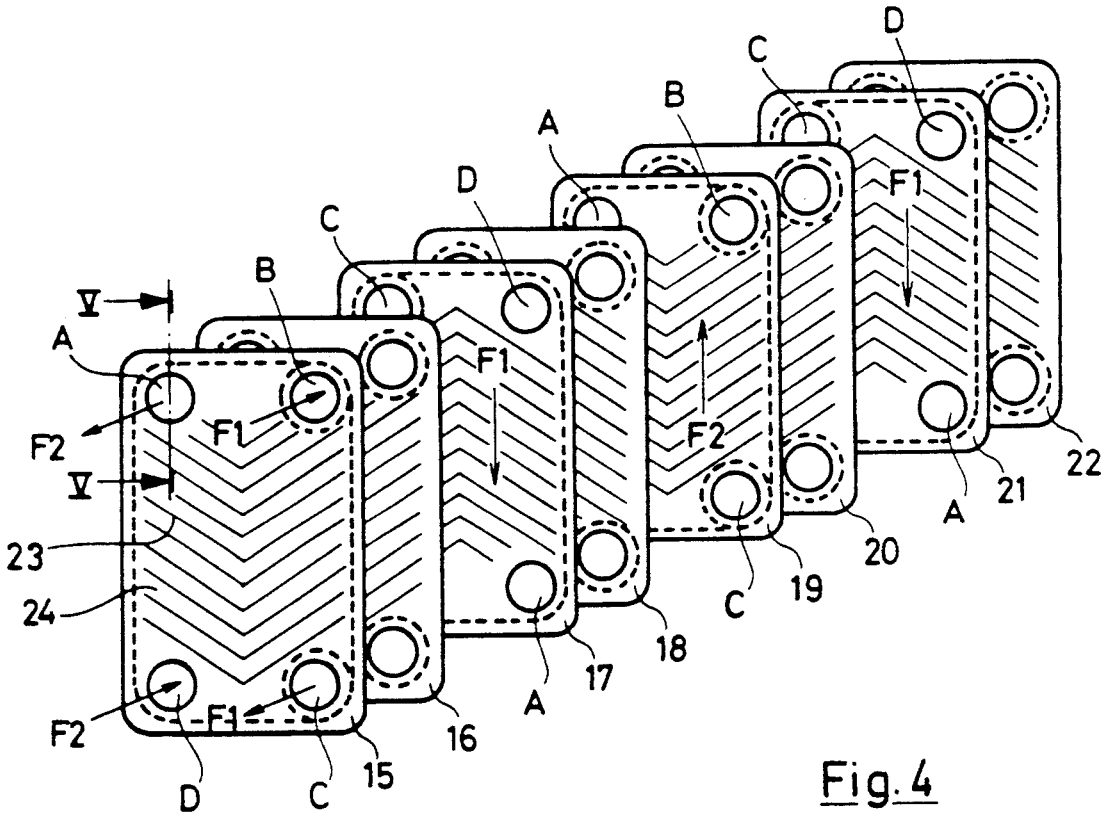
Figure 5:
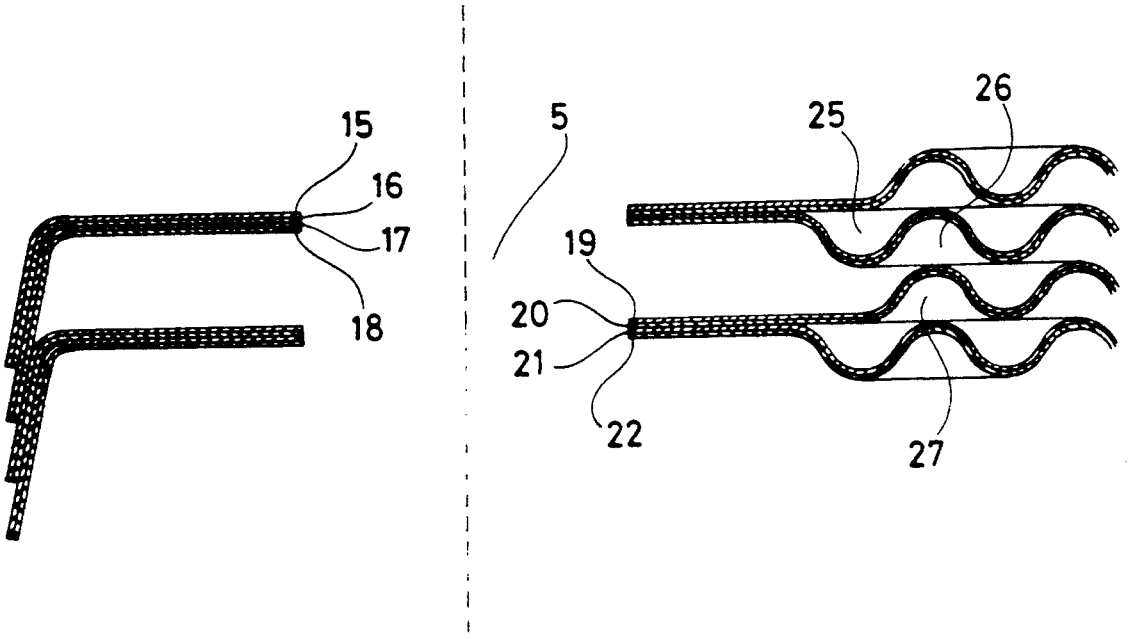

The invention is described in the following with reference to the accompanying drawing, in which FIGS. 1-3 schematically show a plate heat exchanger according to the invention seen from the front (FIG. 1), from the side (FIG. 2) and in section (FIG. 3) along a line III—III in FIG. 1, FIG. 4 schematically shows some of the heat exchange plates in the plate heat exchanger according to FIGS. 1-3, separated from each other, and FIG. 5 shows a section through some of the heat exchange plates in a plate heat exchanger according to the invention, taken along a line V—V in FIG. 4.

The plate heat exchanger in FIGS. 1-3 comprises a package 1 of double heat exchange plates and four end plates 2a, 2b and 3a, 3b. All of the plates are permanently joined together by brazing. The heat exchange plates in their upper part have aligned through-flow openings forming passages 4, 5 through the plate package (FIG. 3). The passage 4 communicates with certain interspaces between the heat exchange plates, whereas the passage 5 communicates with other plate interspaces, as has been schematically indicated in FIG. 3. Two tubular connecting members 6 and 7 are arranged opposite to the passages 4 and 5, respectively, and seal against the outside of the end plate 3a. The connecting members are kept removably pressed against the end plate 3a by means of rods 8 and 9, respectively, which are connected with washers 10 and 11 situated outside the end plate 2a. The rods 8 and 9 extend through central holes in cross-formed oaks 12 and 13, which are firmly connected with the connecting members 6 and 7, respectively. Nuts 14 and 15 are threaded onto the end portions of the rods 8, 9 outside the oaks 12 and 13, respectively.

Corresponding passages, connecting members, rods, oaks, etc. are to be found in the lower part of the plate package, as can be seen from FIGS. 1 and 2.

FIG. 4 shows four double or eight single alike heat exchange plates intended to be included in the plate heat exchanger in FIGS. 1-3. Of the plates being numbered 15-22 the plates 17, 18 and 21, 22 are turned 180° in their respective planes relative to the plates 15, 16 and 19, 20.

The plates 15-22 are produced from thin sheet metal which by pressing has been provided with corrugations in the form of ridges 23 and valleys 24. These ridges and valleys form a herring bone pattern on both sides of the so called heat exchange portion of each plate.

Each plate is rectangular and has in each of its corner portions, in the following called port portions, through-flow opening. Thus, the plates 15, 16, 19 and 20, which all are oriented in the same manner, have aligned through-flow openings A, B, C and D, respectively, and each of the plates 17, 18, 21 and 22 has corresponding through-flow openings A-D, which are placed differently, however, as a consequence of the turning of these plates 180° relative to the other plates.

By dotted lines it has been illustrated in FIG. 4 how the different heat exchange plates are intended to seal against each other, when they are permanently joined in a plate package. Thus, it can be seen that the plates 15 and 16 should be joined and seal against each other only around the through-flow openings A-D. Since the plates 15 and 16 are oriented in the same manner in the plate package, the ridges 23 of the plate 16 will be situated in the valleys on the backside of the plate 15, which valleys form ridges 23 on the front side of the plate 15. Between the plates 15 and 16 there are thus formed no real interspace but the plates have contact with each other substantially all over their surfaces. No heat exchange fluid should normally flow between the plates 15 and 16.

In the same manner the plates 17, 18 and 19, 20 and 21, 22 should have contact with each other and be sealingly joined only around each of the through-flow openings A-D.

The plates 16 and 17, which are oriented in different manners, should define together a plate interspace, through which a heat exchange fluid is to flow. For this purpose these plates should be fluid-sealingly joined together along the edge portions of the plates and around two of the through-flow openings of each plate, as can be seen from FIG. 4. Thus, FIG. 4 shows a dotted line along the edge portion of the plate 17 around both the heat exchange portion and all of the four port portions of the plate 17. Furthermore, a dotted line is shown around the through-flow opening C of the plate 17. A corresponding dotted line should have been shown around the through-flow opening B of the plate, which is hidden however behind the plate 16. As can be seen, there are no dotted lines surrounding each of the openings A and D of the plate 17.

In the interspace between the plates 16 and 17 the ridges 23 of the plate 17 will cross and abut against the ridges on the backside of the plate 16, which are formed by the valleys 24 on the front side of this plate.

The plates 16 and 17 should be permanently joined in all of the contact places formed between abutting ridges, but between these contact places there is formed a flow space between the plates. This flow space communicates with the openings A and D to the right in the plate 17 (with reference to FIG. 4) and with the openings B and C in the plate 16, situated opposite thereto, but the flow space does not communicate with the other openings in these two plates.

In the same manner as the plates 16 and 17 also the plates 20 and 21 coact with each other. The plates 18 and 19 coact in a similar manner, but in this case the flow space between the plates communicates with the openings A and D to the left in the plate 19 (with reference to FIG. 4) and with the openings B and C in the plate 18, situated opposite thereto.

The through-flow openings A-D of the heat exchange plates form passages through the plate package for two heat exchange fluids. By arrows in FIG. 4 it has been illustrated how a first fluid F1 is conducted into the plate package through the opening B of the plate 15 and returns through the opening C of the same plate, and how a second fluid F2 is conducted into the package through the opening D of the plate 15 and returns through the opening A of the same plate. The fluid F1, as shown, will flow during operation of the plate heat exchanger through the spaces coupled in parallel between the plates 16 and 17 and between the plates 20 and 21, whereas the fluid F2 will flow through the space between the plates 18 and 19.

For obtaining abutment between two port portions of a heat exchange plate, for instance No. 18, and two port portions of an adjacent plate, for instance the plate 19, that is turned 180° in is own plate relative to the first said plate, two diagonally placed port portions of each plate are situated in different planes. Thus, the port portions around the openings B and C on the shown side of each plate are situated in the same plane as the crests of the ridges 23, wheras the port portions around the openings A and D on the other side of the plate are situated in the same plane as the crests of the ridges which are formed on this other side of the plate by the valleys 24.

For obtaining abutment between the edge portions of adjacent plates, one of which is turned 180° in its own plane relative to the other, the edge portions of all the plates are bent in the same direction, so that they will partly overlap each other. This can be seen from FIG. 5 showing a section through some coacting plates in a plate heat exchanger according to the invention.

FIG. 5, which can be seen as a section along the line V—V in FIG. 4 through the plates shown there when they are interconnected to a plate package, shows that the plates in pairs abut against each other, surface against surface, without forming any flow space, and that adjacent such plate pairs form between themselves flow spaces 25, 26 and 27 for two heat exchange fluids. The flow spaces 25, 26 and 27 are intended for one heat exchange fluid and the flow space 26 is intended for the other heat exchange fluid. Only the last mentioned flow space 26 communicates with the shown passage 5 through the plate package (see FIG. 3).

The plates 15–18 like the plates 19–22 are fluid-sealingly connected with each other around the passage 5. At the edge portions of the plates only the plates 16, 17 and 18, 19 and 20, 21 are fluid tightly interconnected, whereas the plates 15, 16 and 17, 18 and 19, 20 and 21, 22 only abut against each other.

It has been described above in connection with the plate arrangement in FIG. 4 how two heat exchange fluids are intended to flow in a plate heat exchanger according to the invention. If one of these fluids, for instance the fluid F1, is strongly corrosive end, therefore, after some time of operation of the heat exchanger would cause a hole to be formed in one heat exchange plate, for instance the plate 17, part of the fluid F1 will leak out between the plates 17 and 18. These plates abut closely against each other, but due to the pressure prevailing in the flow space between the plates 16 and 17 the fluid will be pressed out between the plates 17 and 18 and flow further in some direction towards and past the edges of these plates. The leakage then can be noticed, so that measures can be taken before the fluid F1 has caused a hole to come up also in the plate 18 and resulted in mixing of the fluids F1 and F2.

Since, as described above, adjacent plates forming flow spaces between themselves for the fluids F1 and F2 are permanently joined together both along their edges and at a lot of places distributed over the heat exchange portions of the plates, the pressures of the fluids F1 and F2 in the flow spaces will be taken up by the heat exchange plates themselves. The package of heat exchange plates thus need not be held together as a consequence of the forces exerted by the fluids on the heat exchange plates. However, the fluid pressure in the passages 4 and 5, formed by the through-flow openings A–D of the heat exchange plates (FIG. 4), creates forces both against the end plates 2*a* and 2*b* and against the fluid conduits (not shown) which are connected with the connecting members 6 and 7. These forces act in different directions, i.e. they strive at separating the end plates from the package of heat exchange plates and at separating the heat exchange plates from each other.

In a plate heat exchanger according to the invention these last mentioned forces will be taken up by the rods 8 and 9, so that they will not have the said effect of separating the heat exchange plates from each other. Especially vulnerable for separating forces are those adjacent heat exchange plates, e.g. the plates 17 and 18, which are joined together only around the through-flow openings A–D.

A plate heat exchanger according to the invention may be produced in the following manner. First a number of plates are stacked in the manner shown in FIG. 4, a thin folio of a brazing material, having the same size as a plate, being placed in each of the interspaces between the plates 16 and 17, between the plates 18 and 19 and between the plates 20 and 21. In each of the spaces between the plates 15 and 16, between the plates 17 and 18, between the plates 19 and 20 and between the plates 21 and 22 brazing material is placed only in the areas of the port portions of the plates. After that, the end plates 2*a*, 2*b* and 3*a*, 3*b* are mounted and brazing material is placed between them and the package of heat exchange plates. The whole plate package is compressed so that a good contact is subjected to heat within a furnace so that the plates are brazed together.

When the plate package has been removed from the furnace the rods 8, 9 with their washers 10, 11 may be mounted, at any suitable time, and the connecting members 6, 7 with their oaks 12, 13 may be fastened by threading of the nuts 14, 15.

In the shown embodiment of the plate heat exchanger the end plates 2*a*, 2*b* and 3*a*, 3*b* are brazed firmly to the respective adjacent heat exchange plates at several places and fluid-sealingly around areas situated aligned with the passages 4 and 5.

If desired, the end plates may be dispensed with and, instead, the rods 8, 9 at one of their ends may be connected with circular discs—corresponding to the washers 10—which have only a slightly larger diameter than the passages 4, 5 and which upon mounting of the connecting members 6, 7 are fluid-sealingly pressed against the back side of the outermost heat exchange plate of the plate package.

Alternatively, circular discs of the just mentioned kind may be brazed onto the plate package together with their rods 8, 9 at the same time as the plates of the plate package are brazed together.

I claim:

1. In a plate heat exchanger for the transfer of heat between a first fluid and a second fluid having a stack of plate elements held together by holding members, each plate element comprising two superimposed heat transfer plates which form between themselves an interspace for throughflow of one of said fluids, inlet and outlet means for said first fluid communicating with the interspace through every second one of said plate elements, inlet and outlet means for said second fluid communicating with the interspaces through other said plate elements, the heat transfer plates in each of said plate elements having surrounding edges and opposite heat transfer portions and port portions, respectively, said port portions having aligned throughflow openings, each heat transfer plate having protuberances and depressions, formed by pressing, in its heat transfer portion, the heat transfer plates in each of said plate elements being permanently joined together, as by brazing, both around their edges and at several places distributed over their heat transfer portions in a way such that pressure exerted on the heat transfer portions by fluid flowing between the heat transfer plates will be taken up by the heat transfer plates themselves, and each heat transfer plate in each plate element nesting with an adjacent heat transfer plate of an adjacent plate element to facilitate heat transfer from one to the other of said plates of the two adjacent plate elements, but there being no seal between said nested plates around their periphery so that a hole formed during operation in one of said plates will allow fluid from one interspace to escape between said nested plates but will avoid fluid from one interspace entering an adjacent interspace, the improvement wherein;

(a) the edge portions of all the heat transfer plates are bent in the same direction across the planes of the plates so that they overlap each other, (b) each heat transfer plate has at least four port portions with throughflow openings, (c) the heat transfer plates in each plate element abut against each other and are permanently and fluid-sealingly connected with each other along a line surrounding the heat transfer portion of each transfer plate and at least two of its throughflow openings and, also, around each of the other two throughflow openings of each heat transfer plate, (d) the adjacent plate elements abut against each other via the port portions of the respective heat transfer plates and are permanently and fluid-sealingly connected with each other around each of their throughflow openings, and (e) the holding members extend through said throughflow openings of the heat transfer plates.

2. A plate heat exchanger according to claim 1, wherein the heat transfer plates have press patterns of ridges and valleys in their heat transfer portions, the ridges of one heat transfer plate of each plate element crossing and abutting against the ridges of the other heat transfer plate, whereas in a space between two adjacent plate elements ridges of one heat transfer plate extend in alleys of the other heat transfer plate.

3. A plate heat exchanger according to claim 1 wherein the heat transfer plates are alike, one heat transfer plate in each plate element being turned 180° in its own plane relative to the other.

4. A plate heat exchanger according to claim 1 wherein each holding member at each of its ends is connected with a stiff member which is stiffer than one single heat transfer plate and which is fluid-sealingly connected to the outermost plate element in the stack around an area aligned with the through flow openings through which the holding member extends.

5. A plate heat exchanger according to claim 4, wherein the stiff member at one end of the holding member comprises a connecting member for supply or discharge of one of said fluids.

6. A plate heat exchanger according to claim 5, wherein the connecting member is removably connected with the holding member.

7. A plate heat exchanger according to claim 4, wherein the stiff member at one end of the holding member is constituted by a stiff plate, which is fluid-sealingly connected with the outermost plate element in the stack around an area situated aligned with the through flow openings of the other plate elements.

8. A plate heat exchanger according to claim 7, wherein the stiff plate covers at least two areas which are aligned with the through flow openings of the other plate elements in the outermost plate element and connected with at least two holding members.

* * * * *

UNITED STATES PATENT AND TRADEMARK OFFICE

CERTIFICATE OF CORRECTION

PATENT NO. : 5,307,869

DATED : May 3, 1994

INVENTOR(S) : Ralf Blomgren

It is certified that error appears in the above-identified patent and that said Letters Patent is hereby corrected as shown below:

| | | |
|---|---|---|
| Col. 1, | line 15, | cancel "plates" and substitute --places--. |
| Col. 1, | line 46, | cancel "presume" and substitute --presumes--. |
| Col. 2, | line 19, | cancel "member" and substitute --members--. |
| Col. 2, | line 22, | cancel "kid" and substitute --kind--. |
| Col. 5, | line 12, | cancel ", 26". |
| Col. 5, | line 27, | cancel "end" and substitute --and--. |
| Col. 6, | line 12, | after "is", insert --obtained between the plates, after which the plate package is--. |

Signed and Sealed this

Twenty-second Day of November, 1994

*Attest:*

Bruce Lehman

BRUCE LEHMAN

*Attesting Officer*

*Commissioner of Patents and Trademarks*